US005850884A

United States Patent [19]

Rodger et al.

[11] Patent Number: 5,850,884

[45] Date of Patent: Dec. 22, 1998

[54] MOLING APPARATUS

[75] Inventors: Albert Alexander Rodger, Aberdeen; Gavin Stuart Littlejohn, York, both of Great Britain

[73] Assignees: Aberdeen University, Aberdeen, Scotland; The University of Bradford, Bradford

[21] Appl. No.: 727,512

[22] PCT Filed: Apr. 21, 1995

[86] PCT No.: PCT/GB95/00908

§ 371 Date: Jan. 27, 1997

§ 102(e) Date: Jan. 27, 1997

[87] PCT Pub. No.: WO95/29320

PCT Pub. Date: Nov. 2, 1995

[30] Foreign Application Priority Data

Apr. 21, 1994 [GB] United Kingdom ..... 9407902

[51] Int. Cl.[6] ..... B25D 9/00; B25D 11/00; E21B 1/00

[52] U.S. Cl. ..... 173/91; 173/18; 173/211; 175/299

[58] Field of Search ..... 173/49, 91, 117, 173/210, 211, 13, 15, 18; 175/19, 299, 304, 296

[56] References Cited

U.S. PATENT DOCUMENTS

| | | | |
|---|---|---|---|
| 3,431,988 | 3/1969 | Bodine, Jr. | 175/56 |
| 3,734,460 | 5/1973 | Clarkson, Jr. | 173/18 |
| 3,741,315 | 6/1973 | Hilton | 173/105 |
| 4,629,299 | 12/1986 | Whiting et al. | 173/299 |
| 4,903,784 | 2/1990 | Glaser | 173/211 |
| 5,031,706 | 7/1991 | Spektor | 175/19 |

FOREIGN PATENT DOCUMENTS

| | | |
|---|---|---|
| 0 197 456 | 3/1986 | European Pat. Off. . |
| 28 47 128 | 5/1980 | Germany . |
| 2 064 625 | 6/1981 | United Kingdom . |

*Primary Examiner*—Scott A. Smith
*Assistant Examiner*—John Paradiso
*Attorney, Agent, or Firm*—Woodcock Washburn Kurtz Mackiewicz & Norris, LLP

[57] ABSTRACT

A moling apparatus comprises a housing having a head for penetrating ground, an anvil in the housing connected to the head, and a hammer in the housing and spaced therefrom by a spring. A vibrator unit is spaced from the hammer and arranged to transfer vibration to the housing and the hammer. In a first mode of the apparatus, vibration transmitted to the housing causes fluidization of the surrounding ground to allow progressive penetration of the apparatus. In a second mode, the braking effect of the ground on the head causes the hammer to move against the spring and impact the anvil thereby driving the head through the ground, the apparatus being operable at or between each mode.

6 Claims, 5 Drawing Sheets

MOLING APPARATUS

This invention relates to moling apparatus.

Moling apparatus, is used for making holes in the ground, driving pipes into the ground, driving explosives into the ground for mining or military engineering, and for driving coring tubes into the ground to take core samples.

Of the above-mentioned uses of such apparatus, making holes in the ground for pipes, cables and ducts, is an increasingly important area of use for such apparatus because of the advantages such trenchless laying techniques have over the traditional open trench method. Not only are trenchless methods much less labour intensive, they are also less harmful to the environment.

However despite the apparent advantages of such apparatus over open trench methods, existing moling devices are not utilised as extensively as they could be. This is because existing machines tend to be unreliable, difficult to steer accurately without expensive guidance systems, inefficient, and unable to respond to differing ground conditions as the nature of the ground penetrated by the device changes.

U.S. Pat. No. 5,031,706 discloses a self-propelled pneumopercussive ground penetrating machine which addresses some of the above-mentioned problems in an attempt to produce a machine having a decreased energy consumption and increased velocity. The machine includes a hollow cylindrical housing, having a pointed head section, a striker which reciprocates inside the housing and an air distribution mechanism. The machine operates by accelerating the striker by compressed air to cause it to impact the front end of the housing. As a result of the impact the machine penetrates the soil a certain distance. The striker then travels backwards and is braked. This cycle is then repeated. U.S. Pat. No. 5,031,706 is particularly concerned with a valve operated air distribution mechanism which is claimed to increase the efficiency of the machine compared with earlier designs of pneumopercussive machines. The machine includes means for informing an operator of the rate of progress of the machine through the ground so that the operator can tell if the machine hits an obstacle, such as a rock and the operator can put the machine into reverse mode and attempt to steer round the rock. However despite the apparent improvements over existing moling devices the machine disclosed in U.S. Pat. No. 5,031,706 is complicated in design and would appear to be expensive to manufacture due to its complicated design. Further although an increase in efficiency is apparently achieved over existing moling devices, U.S. Pat. No. 5,031,706 does not properly address the problems of steering and response to ground conditions. Finally a less complicated machine could show improvements not only in the cost of the machine itself but also in reliability.

U.S. Pat. No. 3,741,315 provides a device for drilling ground in which the cutting bit is subjected to oscillatory, percussive, vibratory or axial thrust action.

EP-A-0197456 reveals a moling apparatus comprising a housing having a head for penetrating ground and thrust mans for driving said head through the ground.

The present invention is concerned with the provision of a moling apparatus which alleviates some or all of the disadvantages of existing devices.

Thus, according to the present invention, there is provided a moling apparatus comprising:

housing having a head for penetrating ground;

characterized by an anvil disposed in the housing connected to the head, a hammer disposed in the housing and spaced from the anvil by resilient restraint means, and a vibrator unit spaced from the hammer and arranged to transfer vibration to the housing and the hammer; wherein the resilient restraint means and the space between the hammer and the anvil are so dimensioned that in operation in looser ground the hammer does not strike the anvil so that vibration transmitted to the housing causes fluidization of the surrounding ground and penetration of the apparatus; while in progressively harder ground the braking effect of the ground results in progressive compression of the resilient restraint means which is finally sufficient to allow the hammer to strike the anvil and drive the apparatus forwardly in a predominantly percussive mode.

An advantage of the present invention is that the apparatus is self adjusting depending on the resistance to movement provided by the ground. In easily penetrated ground, for example loose sand, vibrations from the vibrator unit are transferred to the housing and the head and this tends to fluidise the sand and make penetration rapid. Under these ground conditions using vibrations in the first mode is more efficient than using impact. However if the machine encounters ground which is more difficult to penetrate, such as clay, the progress of the head through the ground will be arrested and this will cause the hammer and anvil to move closer together such that vibration from the vibrator unit is transferred to the hammer periodically moving the hammer towards the anvil to cause it to strike the same and thus cause the head to, penetrate the ground in a second impact mode.

In this second impact mode vibrations are still transferred to the housing and head of the mole via the reaction forces created in the spring suspension and via the impacts themselves. This combination of vibration and impact enables effective penetration of the more difficult soil conditions. The magnitude of the impacts is directly related to the magnitude of the soil resistance. Thus a vibro-impact machine has the ability to self-adjust, not only its mode of operation, but also the magnitude of the impact energy imparted to the mole body, depending on the soil resistance being experienced. In addition, the machine has the capacity to self-tune itself to generate impacts at a frequency, which is an integer sub-multiple of the vibrational frequency, in order to optimise penetration.

Conveniently, the vibrator unit may comprise a mass oscillatable between two springs.

In one embodiment, the mass may be caused to oscillate by a pneumatic system.

In an alternative embodiment, a hydraulic system may be used to oscillate the mass.

In a further alternative embodiment, the mass may be caused to oscillate by a cam/follower system driven by an electric, hydraulic or pneumatic motor.

In a preferred embodiment, the head is generally conical but includes a series of steps. The steps ease the passage of the head through the ground and give faster penetration rates. The head may be eccentric and remotely rotatable thereby allowing the apparatus to be steered.

The housing may contain instruments such as an accelerometer, a metal detector, an electromagnetometer, a load cell and an acoustic transducer and means to transmit readings taken by these instruments to an operator of the device.

Spacer rings may be provided between the anvil and the head to enable adjustment of the separation of the anvil and the hammer.

Specific embodiments of the invention will now be described, by way of example only, and with reference to the accompanying drawings in which.

Figure 1:
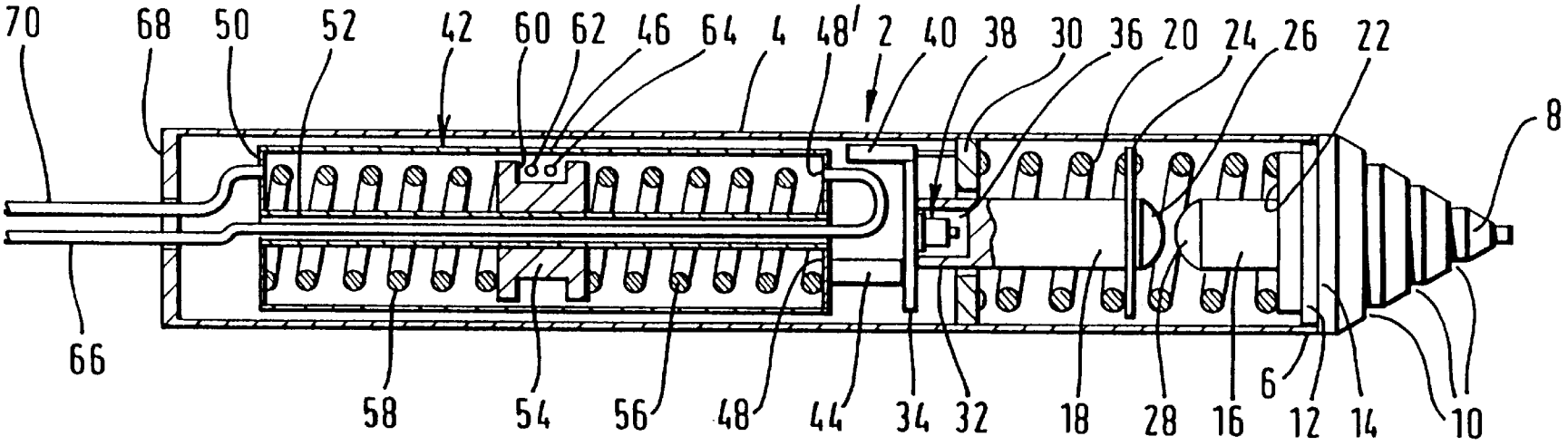
FIG. 1 is a schematic representation of a moling device in transverse cross-section.

Referring to the drawings, FIG. 1 shows a moling device generally indicated at 2. The device includes a cylindrical housing 4, having an annular cross section which in the embodiment is 100 mm in diameter and 3.1 m long. At a front end 6 of the housing there is provided a generally conical head or nose cone 8. A number of steps 10 extend around the nose cone. A number of spacer rings 12 are disposed between a rear end 14 of the nose cone and an adjacent anvil 16.

A hammer 18 opposes and is spaced from the anvil. The separation of the hammer and anvil is maintained by a compression spring 20 which reacts against one end 22 of the anvil closest to the nose cone and a cylindrical plate 24 disposed on the hammer. The opposing parts of the hammer and anvil, 26 and 28 respectively, are rounded. A spring also reacts against an annular baffle which is connected to the housing 4 adjacent a rear end 32 of the hammer furthest from the anvil. The rear end of the hammer passes through the baffle 30 and is connected to a circular plate 34. The rear end of the hammer has an annular cross section defining a cylindrical space 36. An accelerometer 38 is located inside the space 36 and is mounted on the circular plate. The circular plate is connected to the baffle 30 via a LVDT (linear variable differential transformer) 40 which is mounted to an edge of the plate.

On an opposite side of the plate 34 to the hammer there is provided a vibrator unit generally indicated at 42. The vibrator unit is connected to the plate 34 by a cylindrical rod 44. The vibrator unit includes a cylindrical casing 46 having an annular cross-section, a front end 48 and a rear end 50. A hollow cylindrical rod 52 extends from the rear end 50 to the front end 48 of the casing and a mass 54 having a cylindrical bore is mounted on the rod 52 for movement therealong. The mass is biased to remain at the centre of the rod by two springs 58 and 56 which are disposed between the rear end of the casing and the mass, and the mass and the front end of the casing respectively. The mass is generally H-shaped in cross section and is rotationally symmetrical about the rod 52 and thus defines an annular space 60 between itself and casing 46. An air pipe 66 extends from the rear of the casing 68 in the direction toward the nose cone passing through the hollow cylindrical rod 52 before turning and entering the casing 46 via port 48'. A similar air pipe 70 extends from the rear of the casing 46 of the vibrator unit and out of the rear of the device 68.

Figure 2:
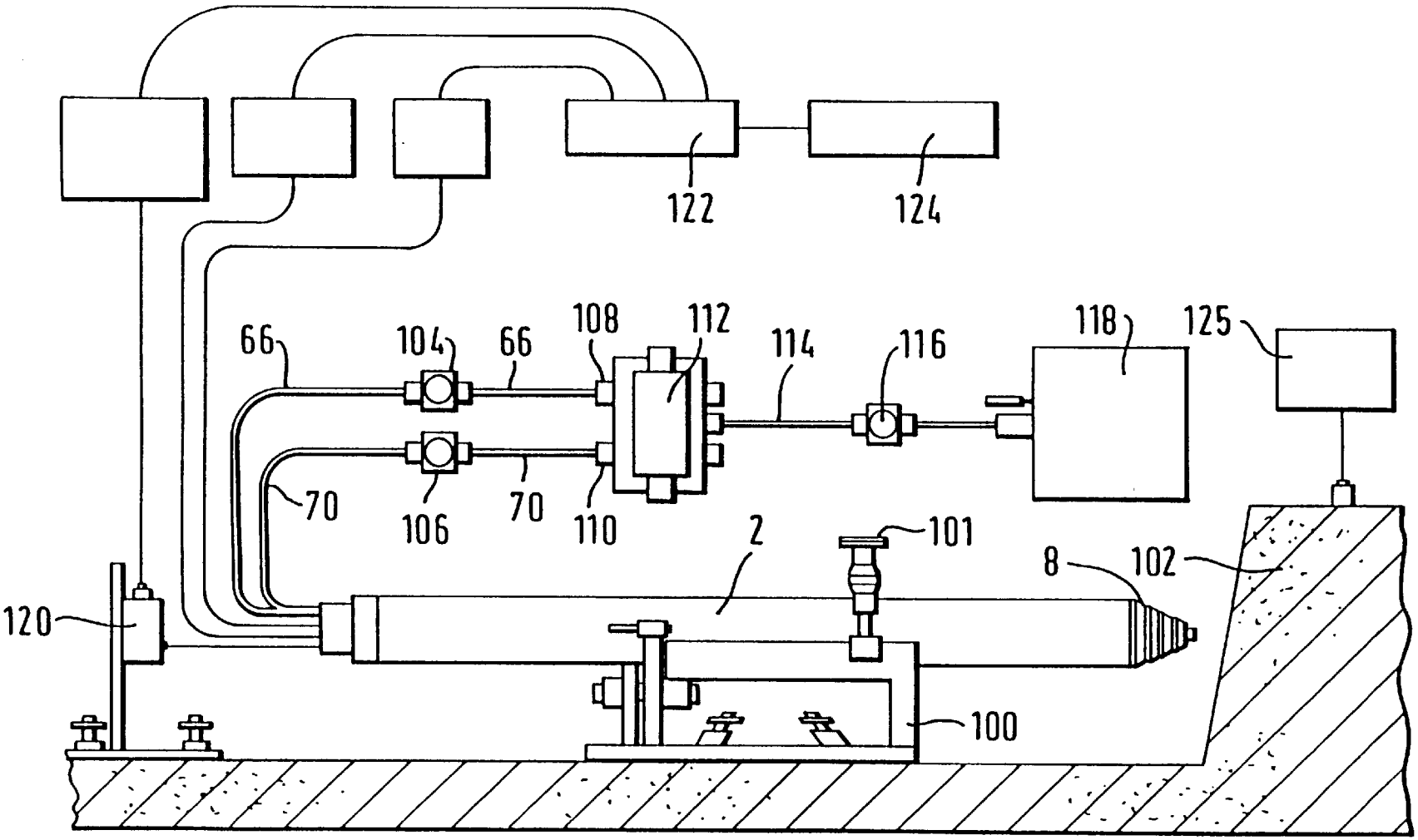
FIG. 2 is a schematic representation of the moling device of FIG. 1 set up for field use.

Turning now to FIG. 2 which shows the device set up for field operation it can be seen that the device is mounted ready for use on a launch rig 100 adjacent a bank of earth into which a hole is to be driven.

Pipes 66 and 70 which extend from the rear of the device to respective air filters 104, 106 which in the described embodiment are Olympic Filters Type F13-000-A3T03. The pipes extend from each respective filter 104, 106 to ports 108, 110 respectively on a solenoid valve 112 which in the described embodiment is a Beech Solenoid Valve Type B/6DSP5C/6123/M/114with the frequency of operation of the valve controllable by a specially designed low frequency (<75 Hz) bi phase solenoid drive unit(not illustrated in the drawings). The drive unit can be preset to a given frequency or used to vary the frequency of operation of the valve 112. A single air pipe 114 extends via a further filter of the same type as filters 104 and 106 to an 85 cfm diesel air compressor 118.

Also illustrated in FIG. 2 are wires connecting the LVDT 40, accelerometer 38, an external displacement transducer 120 (a Celesco type PT-101-350A) to individual signal conditioning units 122 and a magnetic tape recorder 124.

In use the launch rig 100 and a telescopic sight (not shown) are used to correctly align the device. The diesel air compressor is operated and the valve 112 and filters supply compressed air to pipes 66 and 70 alternately at a chosen frequency preferably between 7 and 17 Hz. This causes mass 54 to oscillate causing vibrations at that frequency to be transferred to the casing 46 which are transferred via rod 44 and plate 34 to the hammer 18 and causes the casing 6 and nose cone 8 to vibrate. In loose ground such as sand the nose cone 8 and housing 6 will penetrate the ground quickly, the stepped nose helping to deflect small stones out of the path of the device, and the hammer and anvil will not contact each other because the resistance provided by the ground will not overcome the resilience of the spring 20 separating hammer and anvil, sufficiently. However in harder ground which is more difficult to penetrate, such as clay, the resistance to movement will result in compression of the springs sufficiently to allow the hammer to impact on the anvil this driving the device forward in a predominantly percussive or impact mode. The gap between the anvil and hammer which affects the behaviour of the device, in particular the conditions under which the device changes from vibratory mode to impact mode (or to a mixture of both modes) can be adjusted by varying the number of spacer rings 12.

Figure 4:
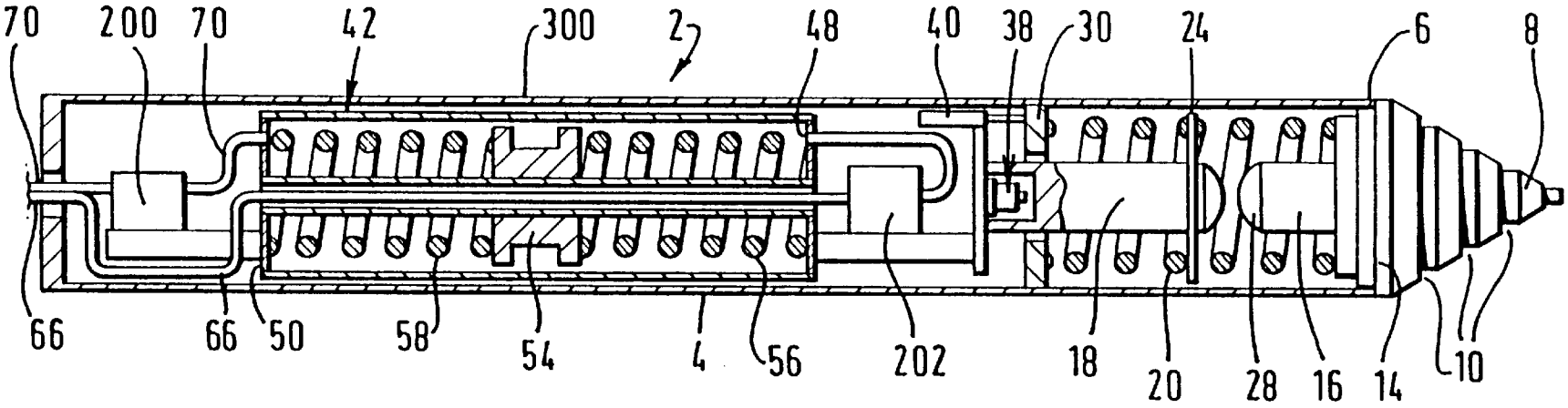
FIG. 4 is a schematic representation of an alternative embodiment of a moling device in which the pneumatic control valves are contained within the body of the mole.

The progression of the device can be monitored by ground effect monitoring device 125. Because of the externally located valve unit 112, the device described above is in practice limited to bores of under 5 m in length. In FIG. 4 there is shown an alternative device, for longer bores, which is identical to that shown in FIG. 1 except that in that two pneumatic valves 200 and 202 are located on pipes 66 and 70 inside housing 4. These two internal single port control valves replace the dual port control valve 112 in this alternative device.

Figure 5:
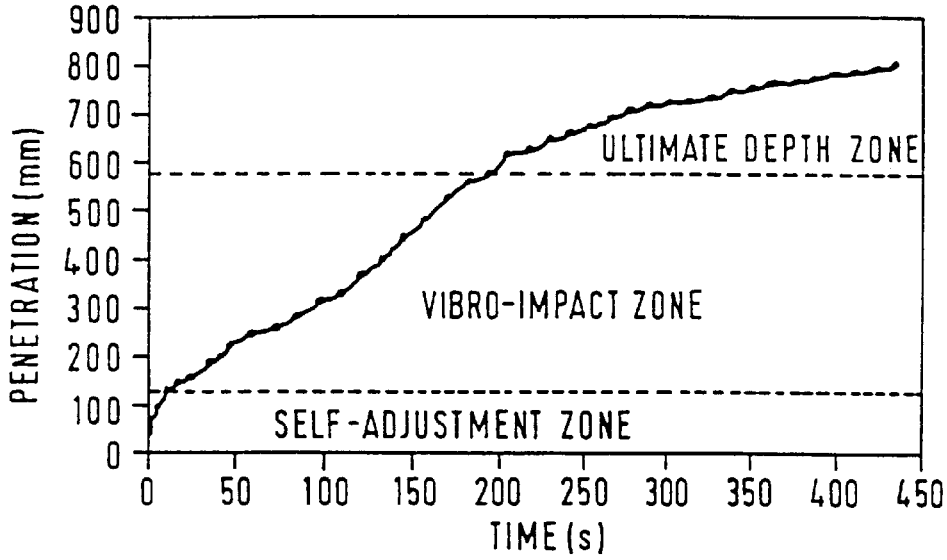
FIG. 5 is a graph illustrating penetration rates of the moling device in various modes of operation.

FIG. 5 shows a graph of the results of field trial of the device which illustrates three distinct zones of soil response to the device when in impact mode. There is an initial self-adjustment mode when the device automatically adjusts to an optimum level of impacts to overcome the resistance of the soil (end resistance). There is then a vibro-impact zone where the gap between hammer and anvil remains constant and a linear penetration time profile is achieved. An ultimate depth zone is eventually reached where the driving energy is insufficient to permit further penetration.

Figure 3:
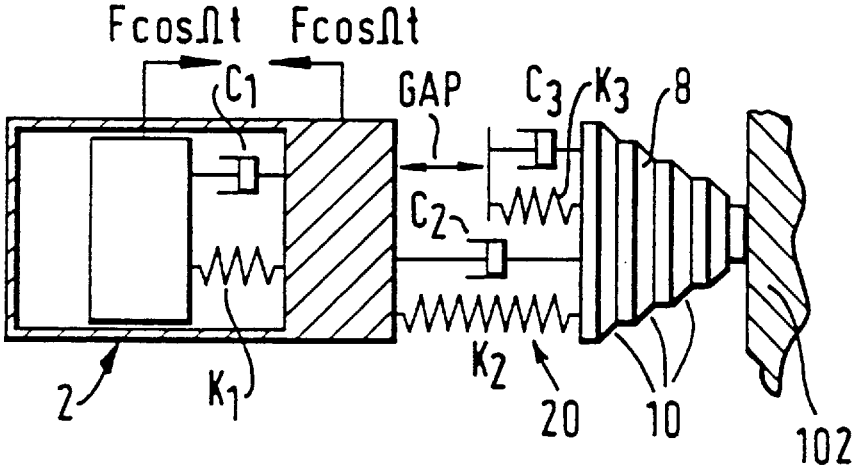
FIG. 3 is a mathematical model of the moling device of FIG. 1.
Figure 6:
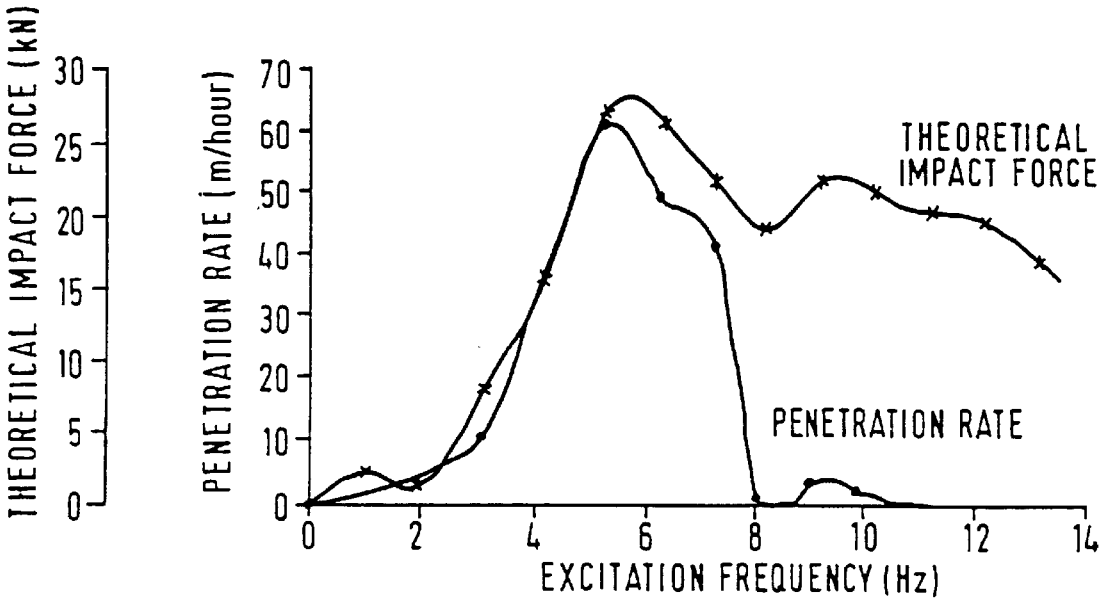
FIG. 6 is a graph comparing field trial penetration rates and theoretical impact force for a range of excitation frequencies.

FIG. 3 shows a mathematical model used for theoretically determining the operational response of the machine. This was achieved using direct numerical integration methods including detection and interpolation routines based on the concept of discontinuity functions. FIG. 6 shows a comparison of the average penetration rates achieved in field trials of the device against the theoretical impact forces predicted by computer model over the frequency range 0 to 13 Hz.

Although both devices described above utilise pneumatically operated vibrator units, a mechanically, electrically or a hydraulically operated unit could be used particularly to enable greater depths of penetration. For example, to enable very long bores to be effected, a mechanically actuated vibrator unit may be employed. The preferred format of this embodiment of the vibrator unit involves oscillating the mass 54 by a cam/follower system operated by either an electric, pneumatic or hydraulic motor.

The device can be used at any angle to the horizontal up to and including vertical orientation. It is possible to fit an end tube to the nose cone 8 to obtain core samples.

In addition to the instruments carried by the device for recording its progress it is also envisaged that the device will carry a metal detector for detecting buried pipes and the like, a magnetometer, an acoustic transducer and a load cell.

By automatically adjusting from vibration mode to impact mode depending on soil conditions the device of the present invention maximises penetration rates under given conditions. This also improves the steering characteristics of the device and reduces the disturbance caused to the surrounding ground.

We claim:

1. A moling apparatus comprising:

a housing having a head for penetrating ground;

an anvil disposed in the housing connected to the head;

a hammer disposed in the housing and spaced from the anvil by resilient restraint means; and a vibrator unit spaced from the hammer and arranged to transfer vibration to the housing and the hammer, wherein the resilient restraint means and the space between the hammer and the anvil are so dimensioned that in operation in looser ground the hammer does not strike the anvil so that vibration transmitted to the housing causes fluidization of the surrounding ground and penetration of the apparatus, while in progressively harder ground the braking effect of the ground results in progressive compression of the resilient restraint means which is sufficient to allow the hammer to strike the anvil and drive the apparatus forwardly in a predominantly percussive mode.

2. An apparatus according to claim 1 wherein the vibrator unit comprises a mass oscillatable between two compression springs, said vibrator unit being separately disposed in said housing.

3. An apparatus according to claim 2 wherein the mass is caused to oscillate by a pneumatic, hydraulic or electrical system.

4. An apparatus according to claim 1 wherein the head is generally conical and includes a series of concentric steps.

5. An apparatus according to claim 4 wherein the head is eccentrically mounted and remotely rotatable thereby allowing the apparatus to be steered in use.

6. An apparatus according to claim 1 wherein spacer rings are provided between the anvil and the head to enable adjustment of the separation of the anvil and the hammer.

* * * * *

UNITED STATES PATENT AND TRADEMARK OFFICE

CERTIFICATE OF CORRECTION

PATENT NO. : 5,850,884

DATED : December 22, 1998

INVENTOR(S) : Albert Alexander Rodger and Gavin Stuart Littlejohn

It is certified that error appears in the above-identified patent and that said Letters Patent is hereby corrected as shown below:

Col. 1, under the title "MOLING APPARATUS" insert the heading --Background of the Invention- and on the next line insert another heading --Feild of the Invention--.

Col. 1, line 58, insert the heading --Summary of the Invention--.
Col. 2, line 63, insert the heading --Brief Description of the Drawings--.
Col. 3, line 13, insert the heading -- Detailed Description of the Preferred Embodiment--.
Col. 3, line 46, change "centre" to --center--.
Col. 4, line 30, change "this" to --thus--.

Signed and Sealed this

Twenty-ninth Day of June, 1999

*Attest:*

Q. TODD DICKINSON

*Attesting Officer*

*Acting Commissioner of Patents and Trademarks*